US007273133B2

(12) United States Patent
Hisamitsu

(10) Patent No.: US 7,273,133 B2
(45) Date of Patent: Sep. 25, 2007

(54) ELEVATOR HOISTING MACHINE

(75) Inventor: Yukimasa Hisamitsu, Shizuoka (JP)

(73) Assignee: Kabushiki Kaisha Meidensha, Tokyo (JP)

( * ) Notice: Subject to any disclaimer, the term of this patent is extended or adjusted under 35 U.S.C. 154(b) by 0 days.

(21) Appl. No.: 11/153,417

(22) Filed: Jun. 16, 2005

(65) Prior Publication Data

US 2006/0169545 A1 Aug. 3, 2006

(30) Foreign Application Priority Data

Jun. 17, 2004 (JP) ..... 2004-179535

(51) Int. Cl.
*B66B 11/08* (2006.01)
*B66B 1/00* (2006.01)
*B66D 1/12* (2006.01)

(52) U.S. Cl. ..... 187/254; 187/277; 254/362

(58) Field of Classification Search ..... 187/254, 187/256, 277; 254/362
See application file for complete search history.

(56) References Cited

U.S. PATENT DOCUMENTS 4,960,186 A * 10/1990 Honda ..... 187/254
5,018,603 A * 5/1991 Ito ..... 187/254
5,631,510 A * 5/1997 Flaig et al. ..... 310/77
5,783,895 A * 7/1998 Hakala et al. ..... 310/268
6,107,714 A * 8/2000 Fischer ..... 310/77
6,397,974 B1 * 6/2002 Adifon et al. ..... 187/254
6,578,672 B1 * 6/2003 Miyoshi ..... 187/254
6,796,548 B2 * 9/2004 Nagata et al. ..... 254/278
6,942,066 B1 * 9/2005 Miyoshi et al. ..... 187/254

FOREIGN PATENT DOCUMENTS

EP 1 118 575 A2 7/2001
EP 1 553 040 A1 7/2005
JP 49-149201 U 12/1974
JP 05-021830 B2 3/1993
JP 2003-201082 A 7/2003
WO 02/103883 A1 12/2002
WO WO 02/103883 A1 12/2002
WO WO 2004/035450 A1 4/2004

* cited by examiner

*Primary Examiner*—Patrick Mackey
*Assistant Examiner*—Eric E. Pico
(74) *Attorney, Agent, or Firm*—Foley & Lardner LLP

(57) ABSTRACT

An elevator hoisting machine includes a first rotary part having a sheave, a brake-side end plate, and a brake disk integrally formed together, a second rotary part having a rotor with a permanent magnet and a motor-side end plate integrally formed together, wherein the second rotary part is coaxially coupled to the first rotary part with the sheave abutting on the rotor. A sheave casing serves to cover the first rotary part and support the inner periphery of the brake-side end plate, and includes a brake main body which makes contact with the brake disk body to provide braking. A frame serves to covers the second rotary part and support the inner periphery of the motor-side end plate, and includes a stator arranged to face the permanent magnet. The sheave casing and frame are coupled together to form an external enclosure.

9 Claims, 4 Drawing Sheets

ELEVATOR HOISTING MACHINE

BACKGROUND OF THE INVENTION

The present invention relates to an elevator hoisting machine.

There have been developed various types of gearless elevator hoisting machines which use no gear. One of the elevator hoisting machines is disclosed in Japanese document JP-U 49-149201. In this elevator hoisting machine, a rotation shaft is rotatably supported on a pair of bearings mounted on a bed. Provided to the rotation shaft are a DC motor, a sheave, and a brake drum. The DC motor is supplied with current through a rectifier, and the sheave has a rope wound thereon.

Another elevator hoisting machine is disclosed in Japanese document JP-B2 5-21830. This elevator hoisting machine includes a revolving-field synchronous motor. In the elevator hoisting machine, first and second supports are distantly disposed on a bed. First and second support shafts are fixed to the first and second supports. An armature is arranged on the first support shaft, and a sheave is arranged on the second support shaft through a bearing. Thus, the sheave is supported in a cantilever way. A permanent magnet is arranged on the inner peripheral surface of a brake wheel integrally formed with the sheave. The permanent magnet and the armature constitute a revolving-field synchronous motor.

SUMMARY OF THE INVENTION

The elevator hoisting machine disclosed in Japanese document JP-U 49-149201 includes rotation shaft for transmitting torque of the DC motor to the sheave and the brake drum. In this case, the rotation shaft and a rotor of the DC motor, the rotation shaft and the sheave, the rotation shaft and brake drum should be fixed together to ensure torque transmission. Thus, assembling should be carried out with working such as key groove, shrinking, or taper joining provided to junctions, leading to complicated assembling work and increase in assembling cost. Further, the DC motor, sheave, and brake drum are not coupled directly, but through the rotation shaft, leading to increase in machine size due to impossible direct coupling. Furthermore, the need of the rotation shaft causes a rise in manufacturing cost.

With the elevator hoisting machine disclosed in Japanese document JP-B2 5-21830, the second support shaft having a great load acting thereon through the sheave is a cantilever, leading to size increase in the second support and the bearing. Moreover, due to mounting of the two supports on the bed, alignment is needed to align the concentric position of the armature and the permanent magnet. Specifically, alignment of the axes of the first and second support shafts is needed in the assembling process.

It is, therefore, an object of the present invention to provide an elevator hoisting machine which allows reduction in size and manufacturing cost and facilitation of assembling.

Generally, the present invention provides an elevator hoisting machine, which comprises: a first rotary part, the first rotary part comprising a sheave, a brake-side end plate extending from an inner peripheral surface of the sheave at a first end radially inward, and a brake rotating body located at the first end of the sheave, the sheave, brake-side end plate, and brake rotating body being integrally formed together; a second rotary part, the second rotary part comprising a rotor having an outer peripheral surface on which a magnet is arranged and a motor-side end plate extending from an inner peripheral surface of the rotor at a second end radially inward, the rotor and motor-side end plate being integrally formed together, the second rotary part being coaxially coupled to the first rotary part with the sheave abutting on the rotor; a sheave casing which covers the first rotary part and supports an inner periphery of the brake-side end plate, the sheave casing comprising a brake braking body which makes contact with the brake rotating body to provide braking; and a frame which covers the second rotary part and supports an inner periphery of the motor-side end plate, the frame comprising a stator arranged to face the magnet, wherein the sheave casing and frame are coupled together to form an external enclosure.

BRIEF DESCRIPTION OF THE DRAWINGS

The other objects and features of the present invention will become apparent from the following description with reference to the accompanying drawings, wherein.

DETAILED DESCRIPTION OF THE INVENTION

Figure 1:
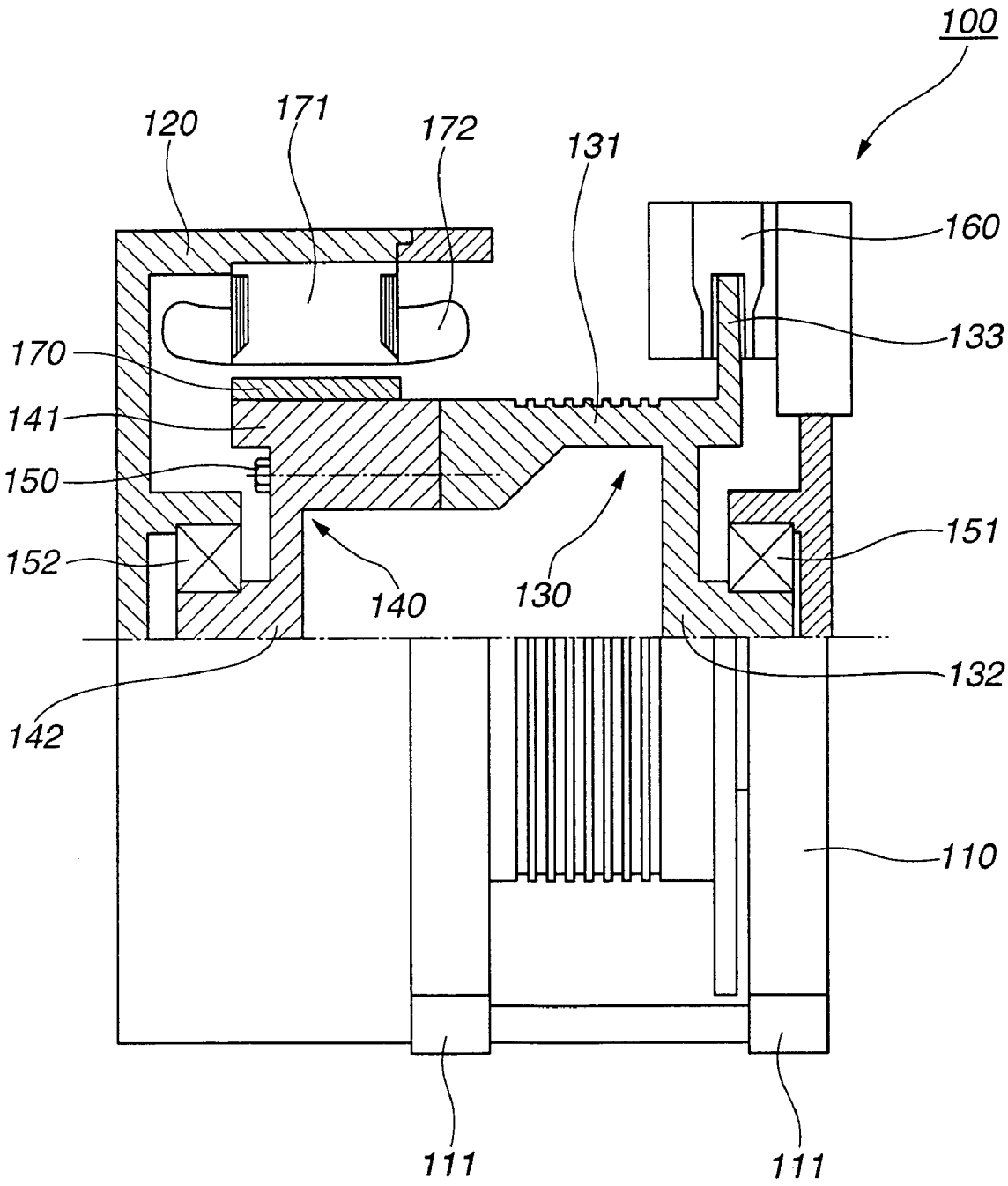
FIG. 1 is an external view, half in section, showing a first embodiment of an elevator hoisting machine according to the present invention.

Referring to the drawings, a description will be made about preferred embodiments of an elevator hoisting machine according to the present invention.

FIG. 1 shows an elevator hoisting machine 100 in the first embodiment. The elevator hoisting machine 100 comprises a sheave casing 110 having a second or left end opened and a frame 120 having a first or right end opened and coaxially coupled to the sheave casing 110 through socket and spigot coupling. The sheave casing 110 and the frame 120 constitute an external enclosure of the elevator hoisting machine 100. Mounting legs 111 are provided to the bottom of the sheave casing 110 to fix and support the elevator hoisting machine 100 in an installation site.

A first rotary part 130 comprises a sheave 131, a brake-side end plate 132, and a brake disk (brake rotating body) 133, which are integrally formed together. A second rotary part 140 comprises a rotor 141 and a motor-side end plate 142, which are integrally formed together. The first and second rotary parts 130, 140 are connected through engagement by a bolt 150. With the sheave 131 abutting on the rotor 141, the first and second rotary parts 130, 140 are in the coaxial state.

The sheave casing 110 covers the first rotary part 130, and supports rotatably the inner periphery of the brake-side end plate 132 through a bearing 151. The frame 120 covers the second rotary part 140, and supports rotatably the inner periphery of the motor-side end plate 142 through a bearing 152. Resultingly, the coupled first and second rotary parts 130,140 are rotatably supported on the external enclosure which comprises sheave casing 110 and frame 120 through the bearings 151,152.

A brake main body (brake braking body) 160 is provided on the top of the sheave casing 110. The brake main body 160 comprises a brake pad forced against the brake disk 133 and the like, wherein braking is obtained by forcing the brake pad against the brake disk 133.

A permanent magnet 170 is provided on the outer peripheral surface of the rotator 141. A stator 171 including a stator winding 172 is provided to the frame 120. The stator 171 is arranged to face the permanent magnet 170. The stator 141 including permanent magnet 170 and the stator 171 including stator winding 171 constitute a synchronous motor.

The structure of the first and second rotary parts 130, 140 will be described.

As is described above, the first rotary part 130 is an integral formation of the sheave 131, brake-side end plate 132, and brake disk 133. The sheave 131 is shaped cylindrically. The brake-side end plate 132 is shaped like a ring in such a way as to extend from the inner peripheral surface of the sheave 131 at its first or right end radially inward, then axially rightward. Its inner periphery extending axially is supported on the bearing 151.

As is described above, the second rotary part 140 is an integral formation of the rotor 141 and the motor-side end plate 142. The motor-side end plate 142 is shaped like a ring in such a way as to extend from the inner peripheral surface of the rotor 141 at its second or left end radially inward, then axially leftward. Its inner periphery extending axially is supported on the bearing 152.

In the elevator hoisting machine 100 constructed in such a way, driving of the synchronous motor causes rotation of the first and second rotary parts 130, 140 to wind or dispense the rope, not shown, for elevator. A load acting on the sheave 131 through the rope is borne on the external enclosure comprising sheave casing 110 and frame 120 through the end plates 132, 142 and the bearings 151, 152. Therefore, a heavy load can firmly be borne by the both lever structure without relying on the shaft structure.

In the first embodiment, the rotor 141, sheave 13, and brake disk (brake rotating body) 133 are coupled directly, resulting in a size reduction.

When the sheave 131 deteriorates, the bolt 150 is loosened to remove the first rotary part 130 including sheave 131. And a new rotary part 130 is set instead, which is coupled to the second rotary part 140. Thus, replacement of the sheave 131 can be achieved easily.

Figure 2:
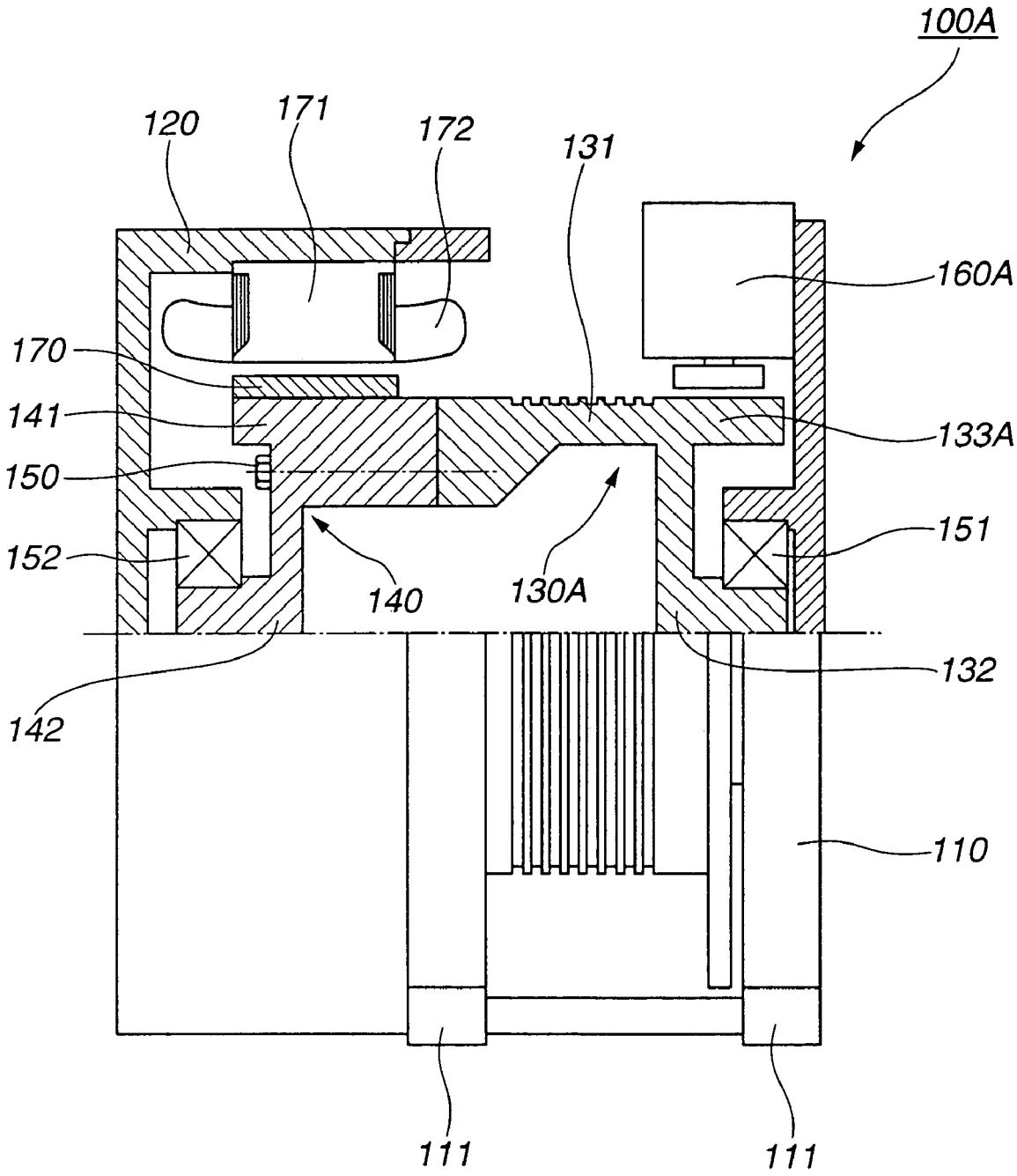
FIG. 2 is a view similar to FIG. 1, showing a second embodiment of the present invention.

FIG. 2 shows an elevator hoisting machine 100A in the second embodiment. The elevator hoisting machine 100A comprises a first rotary part 130A wherein, in place of the brake disk, a brake drum 133A is integrally formed with the sheave 131 and the brake-side end plate 132. A brake main body 160A comprises a braking body, such as brake band or brake shoe, which makes contact with the brake drum 133A, wherein braking is obtained by bringing the braking body into contact with the brake drum 133A.

Other parts in the second embodiment are the same in structure as those in the first embodiment shown in FIG. 1.

Figure 3:
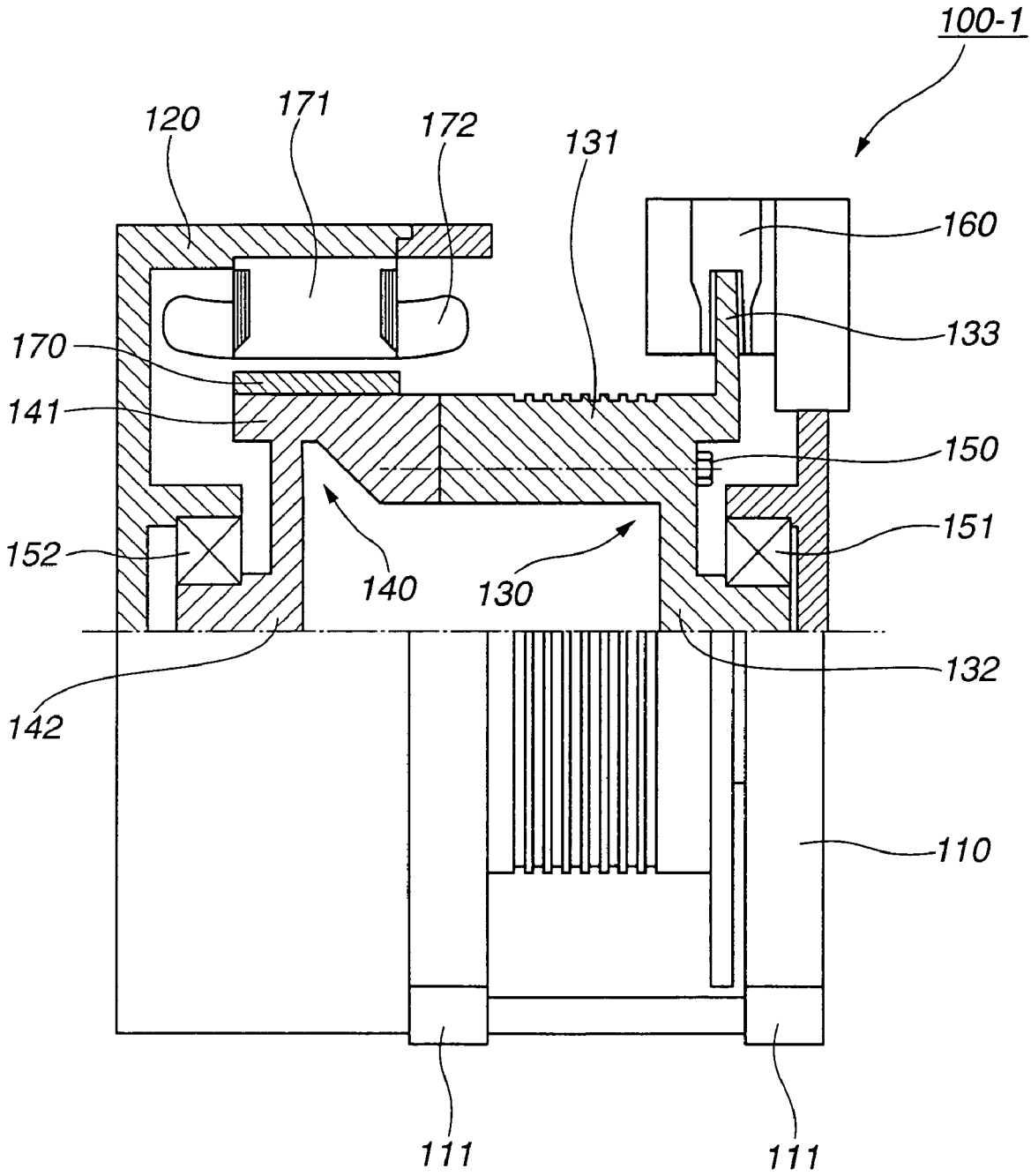
FIG. 3 is a view similar to FIG. 2, showing a third embodiment of the present invention.

FIG. 3 shows an elevator hoisting machine 100-1 in the third embodiment which is a variation of the first embodiment shown in FIG. 1. Specifically, in the first embodiment, the bolt 150 is driven from the side of the rotor 141, whereas in the third embodiment, the bolt 50 is driven from the side of the sheave 131. Moreover, the rotor 141 and sheave 131 are different in shape (thickness shape) from those in the first embodiment, which is not involved in an essential difference, but a mere shape modification due to change in driving direction of the bolt 150.

Other parts in the third embodiment are the same in structure as those in the first embodiment shown in FIG. 1.

Figure 4:
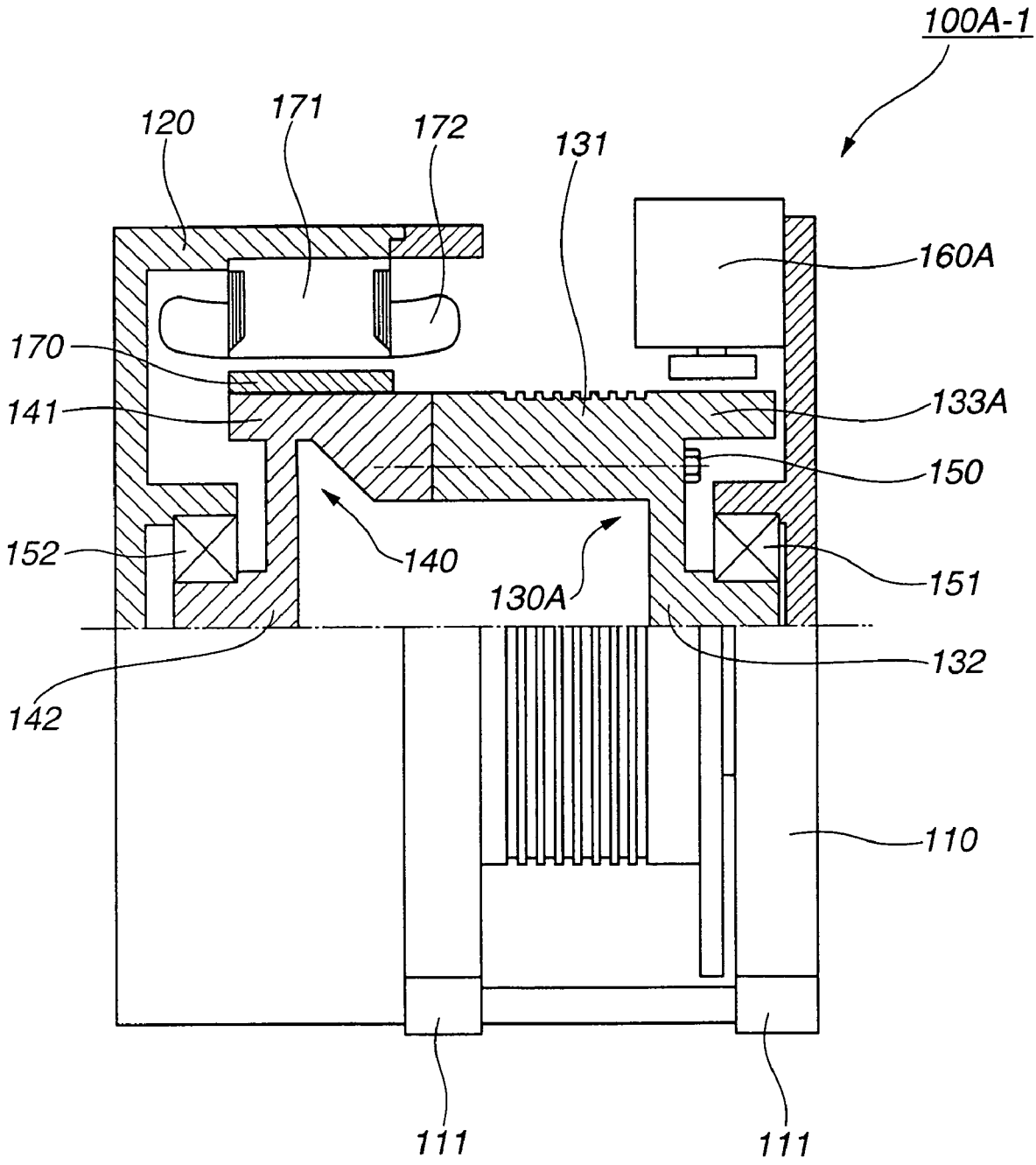
FIG. 4 is a view similar to FIG. 3, showing a fourth embodiment of the present invention.

FIG. 4 shows an elevator hoisting machine 100A-1 in the fourth embodiment which is a variation of the second embodiment shown in FIG. 2. Specifically, in the second embodiment, the bolt 150 is driven from the side of the rotor 141, whereas in the fourth embodiment, the bolt 50 is driven from the side of the sheave 131. Moreover, the rotor 141 and sheave 131 are different in shape (thickness shape) from those in the second embodiment, which is not involved in an essential difference, but a mere shape modification due to change in driving direction of the bolt 150.

Other parts in the fourth embodiment are the same in structure as those in the second embodiment shown in FIG. 2.

According to the present invention, the rotor, sheave, and brake rotating body are coupled directly, resulting in a reduction in whole structure of the elevator hoisting machine. Further, due to no use of the shaft, a reduction in manufacturing cost can be achieved accordingly. Still further, due to direct coupling, key groove machining or the like to the shaft is not needed, resulting in easy assembling. Still further, the bearing support provides both lever structure, allowing firm bearing of a heavy load. Furthermore, due to no use of the bed, axis alignment is not needed in the assembling process, resulting in easy assembling.

Having described the present invention in connection with the preferred embodiments, it is noted that the present invention is not limited thereto, and various changes and modifications can be made without departing from the scope of the present invention.

The entire teachings of Japanese Patent Application P2004-179535 filed Jun. 17, 2004 are hereby incorporated by reference.

What is claimed is:

1. An elevator hoisting machine, comprising:

a first rotary part with a first hollow defined therein, the first rotary part comprising:

a sheave, a brake-side end plate extending radially inward from an inner peripheral surface of the sheave at a first end and having at a diametrically center portion a first shaft portion that extends axially outward, wherein the first shaft portion only extends axially outward from the first hollow, and a brake rotating body located at the first end of the sheave, wherein the sheave, brake-side end plate, and brake rotating body are integrally formed together;

a second rotary part with a second hollow defined therein, the second rotary part comprising:

a rotor having an outer peripheral surface on which a magnet is arranged, and a motor-side end plate extending radially inward from an inner peripheral surface of the rotor at a second end and having at a diametrically center portion a second shaft portion that extends axially outward, wherein the second shaft portion only extends axially outward from the second hollow, wherein the rotor and motor-side end plate are integrally formed together, wherein the second rotary part is coaxially and detachably coupled to the first rotary part, wherein the first and second hollows are merged to constitute an enclosed space between the brake-side end plate and the motor-side end plate with the sheave abutting on the rotor;

wherein said first and second shaft portions are coaxial and are configured so that there is a hollow space between said first and second shaft portions;

a sheave casing which covers the first rotary part and rotatably supports the first shaft portion of the brake-side end plate, the sheave casing comprising a brake braking body which makes contact with the brake rotating body to provide braking; and a frame which covers the second rotary part and rotatably supports the second shaft portion of the motor-side end plate, the frame comprising a stator arranged to face the magnet, wherein the sheave casing and frame are coupled together to form an external enclosure.

2. The elevator hoisting machine as claimed in claim 1, wherein the brake rotating body includes a brake disk, and the brake braking body includes a brake main body comprising a brake pad forced against the brake disk.

3. The elevator hoisting machine as claimed in claim 1, wherein the brake rotating body includes a brake drum, and the brake braking body includes a brake main body comprising a braking body which makes contact with the brake drum.

4. The elevator hoisting machine as claimed in claim 1, wherein the first and second rotary parts are coupled by a bolt.

5. The elevator hoisting machine as claimed in claim 1, wherein the sheave and rotor are shaped cylindrically, and the brake-side end plate and motor-side end plate are shaped like a ring.

6. The elevator hoisting machine as claimed in claim 1, wherein the magnet includes a permanent magnet.

7. An elevator hoisting machine, comprising:

a first rotary part with a first hollow defined therein, the first rotary part comprising:

a sheave, a brake-side end plate extending radially inward from an inner peripheral surface of the sheave at a first end and having at a diametrically center portion a first shaft portion that extends axially outward, wherein the first shaft portion only extends axially outward from the first hollow, and a brake rotating body located at the first end of the sheave, wherein the sheave, brake-side end plate, and brake rotating body are integrally formed together;

a second rotary part with a second hollow defined therein, the second rotary part comprising:

a rotor having an outer peripheral surface on which a magnet is arranged, and a motor-side end plate extending radially inward from an inner peripheral surface of the rotor at a second end and having at a diametrically center portion a second shaft portion that extends axially outward, wherein the second shaft portion only extends axially outward from the second hollow, wherein the rotor and motor-side end plate are integrally formed together, wherein the second rotary part is coaxially and detachably coupled to the first rotary part, wherein the first and second hollows are merged to constitute an enclosed space between the brake-side end plate and the motor-side end plate with the sheave abutting on the rotor;

wherein said first and second shaft portions are coaxial and are configured so that there is a hollow space between said first and second shaft portions;

first means for covering the first rotary part and rotatably supporting the first shaft portion of the brake-side end plate, the first means comprising a brake braking body which makes contact with the brake rotating body to provide braking; and second means for covering the second rotary part and rotatably supporting the second shaft portion of the motor-side end plate, the second means comprising a stator arranged to face the magnet, wherein the first and second means are coupled together to form an external enclosure.

8. The elevator hoisting machine as claimed in claim 7, wherein the first means comprise a sheave casing.

9. The elevator hoisting machine as claimed in claim 7, wherein the second means comprise a frame.

* * * * *